US008484895B2

(12) United States Patent
Kuhnmuench

(10) Patent No.: US 8,484,895 B2
(45) **Date of Patent: *Jul. 16, 2013**

(54) DOOR CONFIGURATION WITH A PIVOTING DOOR AND SLIDING DOOR FUNCTION WHICH CAN BE ACTUATED BY A SINGLE ACTUATING ELEMENT

(75) Inventor: Norbert Kuhnmuench, Pfinztal (DE)

(73) Assignee: Bruker AXS GmbH, Karlsruhe (DE)

( * ) Notice: Subject to any disclaimer, the term of this patent is extended or adjusted under 35 U.S.C. 154(b) by 701 days.

This patent is subject to a terminal disclaimer.

(21) Appl. No.: 12/385,823

(22) Filed: Apr. 21, 2009

(65) Prior Publication Data

US 2010/0107499 A1 May 6, 2010

(30) Foreign Application Priority Data

Apr. 25, 2008 (DE) ..... 10 2008 020 729

(51) Int. Cl.
*E05D 15/22* (2006.01)

(52) U.S. Cl.
USPC ..... 49/164; 49/149; 49/188; 49/254

(58) Field of Classification Search
USPC ..... 49/149, 163, 164, 168, 254, 255, 49/256, 257, 258, 259, 260, 261, 152, 153, 49/155, 158, 159, 160, 188, 189; 292/137, 292/138, 143, 145, DIG. 46, DIG. 21
See application file for complete search history.

(56) References Cited

U.S. PATENT DOCUMENTS

| | | | | |
|---|---|---|---|---|
| 1,907,237 | A * | 5/1933 | Berger | 49/164 |
| 2,602,527 | A * | 7/1952 | Simpkins | 49/361 |
| 3,612,601 | A * | 10/1971 | Himka et al. | 296/51 |
| 4,034,510 | A | 7/1977 | Huelsekopf | |
| 4,302,907 | A * | 12/1981 | Canals et al. | 49/65 |
| 4,305,227 | A * | 12/1981 | Georgelin | 49/141 |
| 6,061,961 | A * | 5/2000 | Rupe | 49/164 |
| 6,422,287 | B1 | 7/2002 | Wilke | |
| 6,966,158 | B1 * | 11/2005 | Christensen | 52/213 |
| 7,404,363 | B2 * | 7/2008 | Dunstan | 109/70 |
| 2007/0119548 | A1 | 5/2007 | Anderson | |

FOREIGN PATENT DOCUMENTS

| | | |
|---|---|---|
| DE | 87 06 410 | 6/1987 |
| EP | 1 340 598 | 9/2003 |
| FR | 1 092 099 | 4/1955 |
| JP | 06 081 547 | 3/1994 |

* cited by examiner

*Primary Examiner* — Katherine Mitchell
*Assistant Examiner* — Catherine A Kelly
(74) *Attorney, Agent, or Firm* — Paul Vincent

(57) ABSTRACT

A door configuration, which improves the operating and locking mechanism and facilitates construction and handling, comprising a door having a sliding door disposed on a casement such that it can be slidably displaced and the casement can he pivoted about an axis relative to a main frame. A lock is provided for locking and unlocking the casement with respect to the main frame, and an operating element is disposed on the sliding door, which can be moved with the sliding door and can be switched between a first position and a second position, wherein, in the first position, the operating element does not obstruct movement of the sliding door on the casement, and, in the second position, the operating element engages with the latch or a carrier, such that, when the casement is closed, the latch is operated when the sliding door is moved.

23 Claims, 8 Drawing Sheets

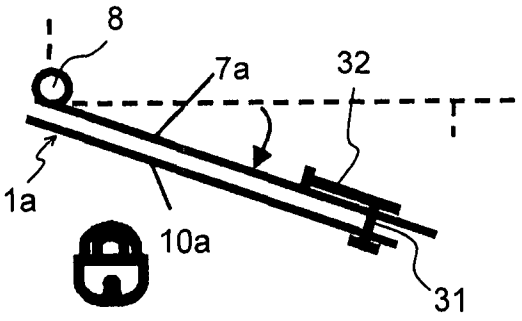
Fig. 3d
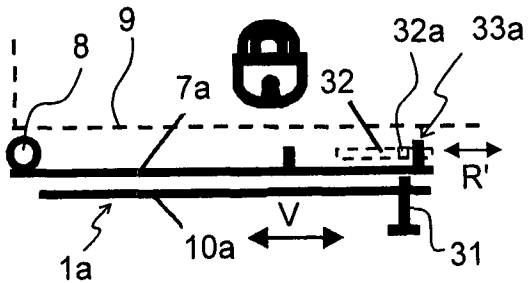
Fig. 3e
Fig. 3a
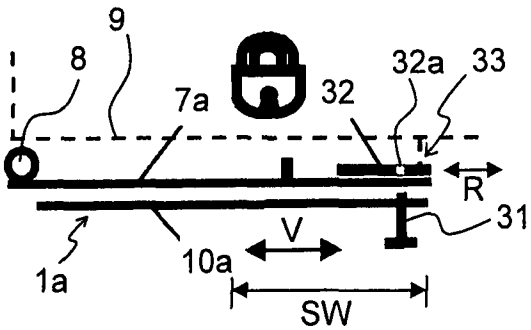
Fig. 3b
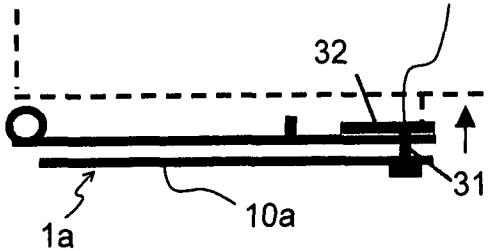
Fig. 3c
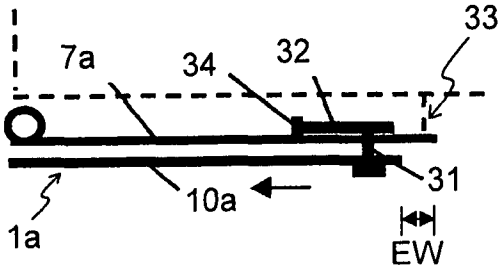

DOOR CONFIGURATION WITH A PIVOTING DOOR AND SLIDING DOOR FUNCTION WHICH CAN BE ACTUATED BY A SINGLE ACTUATING ELEMENT

This application claims Paris Convention priority of DE 10 2008 020 729.2 filed Apr. 25, 2008 the complete disclosure of which is hereby incorporated by reference.

BACKGROUND OF THE INVENTION

The invention concerns a door configuration, comprising a door for opening and closing an access, wherein the door can be pivoted about an axis S relative to a main frame of the door configuration, wherein the door has a sliding door that is disposed on a casement of the door such that it can be displaced in a direction V, and wherein the casement can be pivoted about the axis S relative to the main frame.

Door configurations of this type are known e.g. from doors with sliding windows (see http:/www.woelfleder.at/tuere.htm, April 2008).

Door configurations are generally used to reversibly close an access, in particular, block, cover or seal it. A door configuration thereby comprises a movable part, in the present case called door, and a non-movable part, in the present case called main frame. The door is thereby movably disposed on the main frame. An access that can be closed by a door may e.g. be a passage into a room of a building, or also an engagement opening into a cabinet or a housing.

Folding doors are widely used, which are disposed on the main frame (e.g. a door frame or a wall unit) such that they can be pivoted about a (usually vertical) axis. The overall access that is covered by the door can be opened by pivoting the folding door. The door may be simply borne via hinges or joints. When a folding door is opened, a relatively large amount of space is required in front of the access as a pivoting area for the door.

In practice, it is often not required or not desired to open the entire access that can be closed by a door. In such cases, another, smaller door is conventionally integrated in a folding door. In former times, for example, town or castle gates often had so-called "manholes". Such a manhole is merely a head-high folding door that is inserted into a door wing, through which individuals could pass. To allow passage of vehicles, the town or castle gate was completely opened. The further smaller door only opens part of the access that can be closed by the entire door. Operation of the further, smaller door is generally easier than opening the entire gate, and also requires a smaller amount of free space in front of the access.

The above-mentioned doors having sliding windows basically represent doors on which, in turn, a sliding door is supported for opening part of the access that can be closed by the entire door. The sliding door can be used without requiring any free space in front of the access, and can therefore be used, in particular, when space is limited.

The pivotable part of the door, on which the sliding door is disposed and with respect to which the sliding door can be moved, is called a casement in the present case.

Door configurations having a double function, i.e. a casement and sliding door function, conventionally have independent operating and locking mechanisms for each function. This results in a relatively complex construction, and frequent change between the functions makes handling complicated.

It is therefore the object of the present invention to improve the operating and locking mechanism of a door configuration of the above-mentioned kind having a casement and sliding door function and, in particular, simplify the construction and handling.

SUMMARY OF THE INVENTION

This object is achieved by a door configuration of the above-mentioned type, which is characterized in that a latch is provided for locking and unlocking the casement in its closed state with respect to the main frame, an operating element is disposed on the sliding door, which can be moved with the sliding door and can be switched over between a first position and a second position, wherein, in the first position of the operating element, the operating element does not obstruct movement of the sliding door on the casement, and movement of the sliding door does not influence the latch position, and wherein, in the second position of the operating element, the operating element engages in the latch or a carrier that is rigidly connected or hinged to the latch, such that, when the casement is closed, the latch is operated by moving the sliding door in the second position of the operating element.

The invention provides simple and reliable operation both of the casement function (pivoting or swinging open the casement or the entire door) and of the sliding frame function (movement of the sliding door when the casement is closed). The sliding door has an operating element that is preferably integrated in a handle that is supported on the sliding door. The operating element can be switched over between the first and the second position by a human operator (at least and preferably only when the casement is closed), e.g. by exerting a pressure onto the operating element.

In order to be able to operate the sliding door function, the operating element is in the first position. In this first position, the latch locks the casement such that it is maintained in the closed position. By manually laterally pulling the sliding door (or an associated handle), the sliding door can be moved with respect to the casement in order to open part of the access opening. The first position is the standard position for the operating element. The operating element is typically pretensioned in this first position.

In order to be able to operate the casement function, the operating element is switched into the second position. The latch is operated by a manual lateral pulling action on the sliding door and the sliding door is also moved with respect to the casement, but typically only within a narrow range ("unlocking path"). As soon as the latch is unlocked, the casement can be opened by pulling forward the sliding door.

The inventive door configuration realizes the mechanical change between the two operating modes of the door mechanism in the simplest fashion (sliding door function and folding door function). Only one operating element is required to handle the sliding door (or an associated handle). Operation of the different operating modes at the same time is preferably prevented by locking and blocking mechanisms, i.e. when the sliding door is opened, the folding door cannot be unlocked, and when the casement is open, the sliding door cannot be opened. In particular, switching over of the operating element from the first position to the second position is preferably blocked when the sliding door is not closed.

In accordance with the invention, the door with pivoting function ("folding door") has an additional sliding door function. The overall access can be opened via the pivotable casement that also pivots the sliding door. This is useful, in particular, for moving large objects or persons through the access. When only a smaller part of the access is required, e.g. for moving only relatively small objects through the access, the sliding door function can be used while the casement is closed, wherein generally only a small part of the access is opened. The sliding door does, in particular, not require any free space in front of the access, such that in case of space shortage, it is not necessary to maintain a minimum separation from any oppositely disposed devices for the sliding door function. If the sliding door is narrow in the direction of displacement V, it can be displaced only in front of the access without requiring any free space. If a wider sliding door is used, space is required only on the sides of the access, which, however, often only minimally impairs the options of using the space.

In one preferred embodiment of the inventive safety housing, the closed sliding door covers the entire access that can be closed by the door when the casement is closed. In other words, the overall door is designed as a sliding door that can also be pivoted as a folding door. The casement can then be limited to its function as a bearing for the sliding door. In this case, it is not necessary to provide (partial) covers for the access on the casement.

In another embodiment, the sliding door extends in a direction perpendicularly to the direction V over the entire height of the access that can be closed by the door. In this case, the sliding door opens a maximum part of the access without requiring additional space in front of the access.

In a particularly preferred embodiment, a partial cover for the access is rigidly mounted to the casement, and, when the casement is closed and the sliding door is closed,

- the sliding door extends over a first partial area of the access in a direction parallel to the direction V, and
- the partial cover that is rigidly mounted to the casement, extends over a second partial area of the access in a direction parallel to the direction V, wherein the first plus second partial areas cover the entire width of the access that can be closed by the door, in particular, wherein the first and the second partial areas overlap. In this embodiment, a movable partial cover of the sliding door and the partial cover that is rigidly disposed in the casement supplement each other. When the sliding door is opened, its partial cover is preferably slid over the partial cover that is rigidly disposed in the casement, such that no free space is required next to the access for opening the sliding door. In this embodiment, the surface portion of the displaceable partial cover of the door can be further reduced in order to simplify the construction.

In one preferred further development of this embodiment, the first partial area extends approximately over half the width of the access parallel to the direction V when the casement and the sliding door are closed. The second partial area also extends over approximately half the width of the access (namely its other half). This opens a maximum part of the access by opening the sliding door without requiring free space next to the access.

In another preferred embodiment, the sliding door covers the access in a border area of the access remote from the axis S, when the sliding door and the casement are closed, and the sliding door can be slid open from its closed position towards the axis S. This reduces the bearing forces that act on the suspensions (hinges, pivot joints) of the casement when the sliding door is open. This is also facilitated by combined actuation of the casement and the sliding door by means of the same handle and operating element.

In one particularly preferred embodiment, in the second position of the operating element, a latch position associated with the closed sliding door locks the casement and a locked position associated with a moved sliding door releases the casement. In this embodiment, it is sufficient to operate only one single safety locking per door (with sliding and casement function) to secure access (with respect to both functions). The safety lock only needs to check or ensure that the sliding door is closed, since in this case, the folding door is inevitably also locked.

In a preferred further embodiment, the range of movement of the sliding door away from the closed position in the second position of the operating element is defined by a mechanical stop to an unlocking path EW which is shorter than the maximum sliding path SW of the sliding door on the casement in the first position of the operating element, in particular, wherein $EW \leqq 0.2*SW$, and in particular wherein $EW \leqq 5$ cm. The mechanical stop marks a sliding door position in which the latch is unlocked. Any further unnecessary and tedious movement of the sliding door is avoided. When the casement is displaced, the sliding door is largely closed such that the sliding door does not obstruct opening of the casement.

In a preferred further development of this embodiment, a locking mechanism is provided on the door, which blocks movement of the sliding door out of the position of movement of the sliding door on the mechanical stop when the casement is not closed and when the operating element is located in the second position, in particular, wherein a movable locking element is provided on the casement, which is pretensioned by a spring force into a locking position, in which it blocks the movement path of the operating element or of the latch or the carrier in the second position, and is moved out of the path of movement of the operating element or the latch or the carrier in the second position when the casement is closed through interaction with a counter means that is rigidly formed on the main frame. This further development prevents operating errors of the door mechanism (in particular locking mechanism). The latch that is operated via the operating element remains in the unlocked position when the casement is opened in order to ensure smooth closing of the casement. The sliding door is typically blocked on the mechanical stop through positive fit with a locking element that is movably disposed on the casement. This positive fit may be realized in the simplest form directly with the operating element, or also with the latch or any carrier, which are respectively coupled to the operating element, thereby blocking the sliding door.

In a further development, a blocking mechanism is alternatively or additionally provided, which blocks a movement position of the sliding door on the mechanical stop. This also prevents operating errors of the door mechanism.

The blocking mechanism comprises e.g. a resilient ball in the casement, which engages in a recess on the latch to provide a resistance to movement of the sliding door, which is very easy to realize.

In another example, the blocking mechanism is provided by a third position of the operating element, in which a holding element of the casement blocks movement of the operating element, in particular, wherein the operating element is driven by the force of a spring from the second position into the third position and in particular, wherein the third position is formed between the first and the second position.

In a particularly preferred embodiment, a guidance is provided on the casement, which holds the operating element in the second position when the sliding door is moved out of its closed position, when the operating element is in the second position, and which only permits changing between the first and the second position when the sliding door is closed. This also prevents operation errors of the door mechanism (in particular locking mechanism). In particular, when the casement is open, the sliding door cannot be normally moved (i.e. as in the first position of the operating element).

In a preferred further development thereof, the guidance comprises a recessed rail along which the operating element (in the second position) can be guided within a notch in the operating element. The recessed rail has a widening through which the operating element can be displaced between a first and a second position when the sliding door is closed. The guidance can thereby be realized in a very simple mechanical fashion. The widening is typically provided at one end of the recessed rail.

In another preferred embodiment, the operating element comprises a pin that can be retracted and extended and is pretensioned by a spring force into a retracted position which corresponds to the first position of the operating element, and which can be pushed by hand into an extended position which corresponds to the second position of the operating element. This simplifies utilization of the sliding door function that is normally used more often, and inadvertent activation of the folding door function is impeded.

In another preferred embodiment, the latch is disposed on the casement such that it can be displaced in a direction R, wherein the direction R and the direction V extend parallel to each other. Bearing and guiding the latch on the casement facilitates control of the operating element by the latch.

In an alternative fashion, the latch may also be disposed on the main frame such that it can be displaced in a direction R', wherein the direction R' and the direction V extend parallel to each other when the casement is closed. This facilitates a particularly robust design of the latch mechanism.

In another preferred embodiment, a lock is provided on the main frame, which blocks and releases the position of movement of the sliding door when the casement and the sliding door are closed. Any opening of the door, i.e. of the casement or the sliding door, requires movement of the sliding door out of its closed position. For this reason, one single lock is sufficient (that secures the position of movement of the sliding door) for locking the entire door including both functions.

In a further preferred embodiment, the direction V, in which the sliding door can be moved with respect to the casement, extends perpendicularly to the axis S. This has turned out to be useful in practice, in particular, in that the overall motion for opening the casement is facilitated. The axis S typically extends in a vertical direction and the direction V extends in a horizontal direction.

In another preferred embodiment, the casement has the shape of a C, wherein the open side of the C-shaped frame faces away from the axis S. This improves accessibility to the working chamber, in particular, in case of a double-wing door configuration.

Finally, in another particularly preferred embodiment, two adjacent doors are provided, wherein the two doors form two opposite wings of a double door, in particular, wherein the door protection elements of the two doors overlap. The partial areas of the accesses to the working chamber, which are opened in each case by sliding door functions, can then be used together.

The door (i.e. the casement including sliding door) of an inventive door configuration is also preferably designed such that it can be unhinged, e.g. by means of hinges on the main frame, out of which the door can be lifted. This facilitates assembly and transport of the door configuration components.

Further advantages of the invention can be extracted from the description and the drawing. The features mentioned above and below may be used in accordance with the invention either individually or collectively in arbitrary combination. The embodiments shown and described are not to be understood as exhaustive enumeration but have exemplary character for describing the invention.

The invention is illustrated in the drawing and is explained in more detail with reference to embodiments.

BRIEF DESCRIPTION OF THE DRAWING

FIGS. 3*a* to 3*d* show schematic views of the process of changing the operating modes of a door of an inventive door configuration;

FIG. 3*e* shows a schematic view similar to FIG. 3*a* but with a latch that is disposed on the main frame;

DESCRIPTION OF THE PREFERRED EMBODIMENT

Figure 1B:
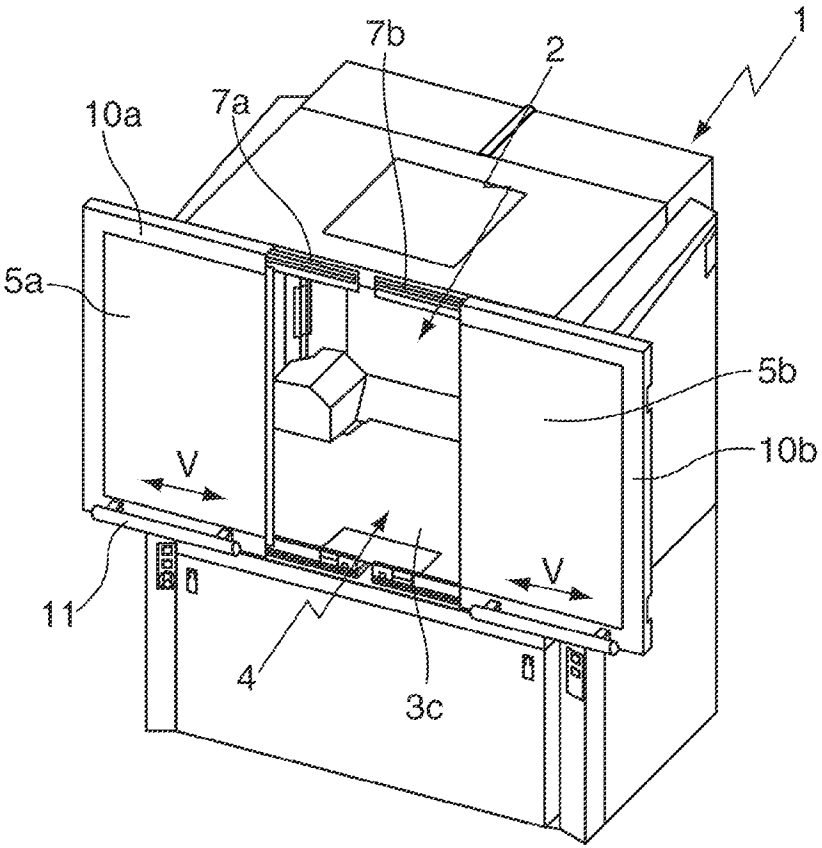
FIG. 1*b* shows the cabinet-like housing of FIG. 1*a* with closed casement and opened sliding door.
Figure 1A:
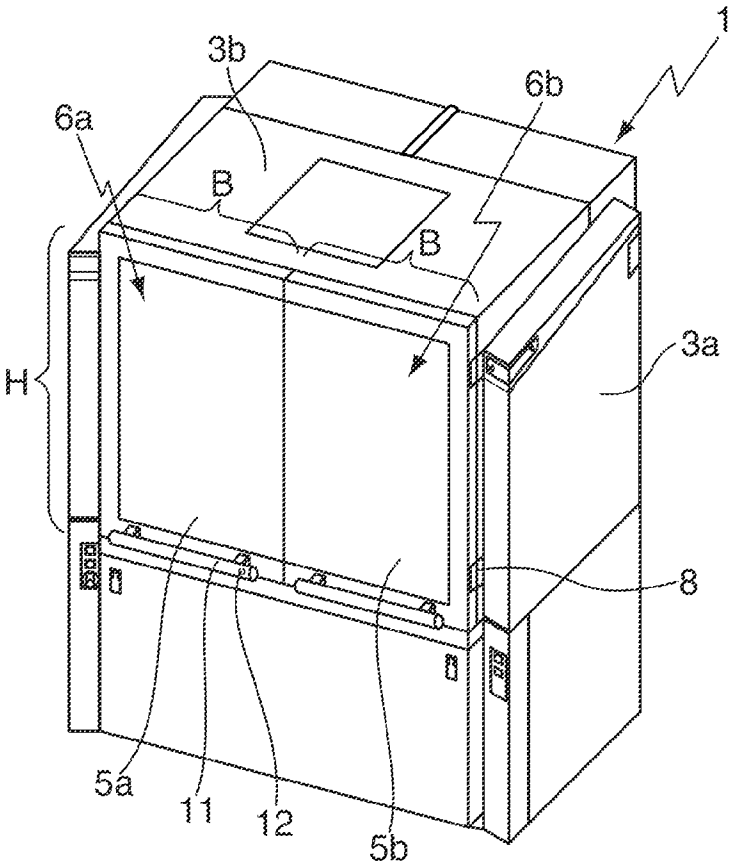
FIG. 1*a* shows a schematic perspective view of a cabinet-like housing with two inventive door configurations, with two doors with closed casement and closed sliding door.
Figure 1C:
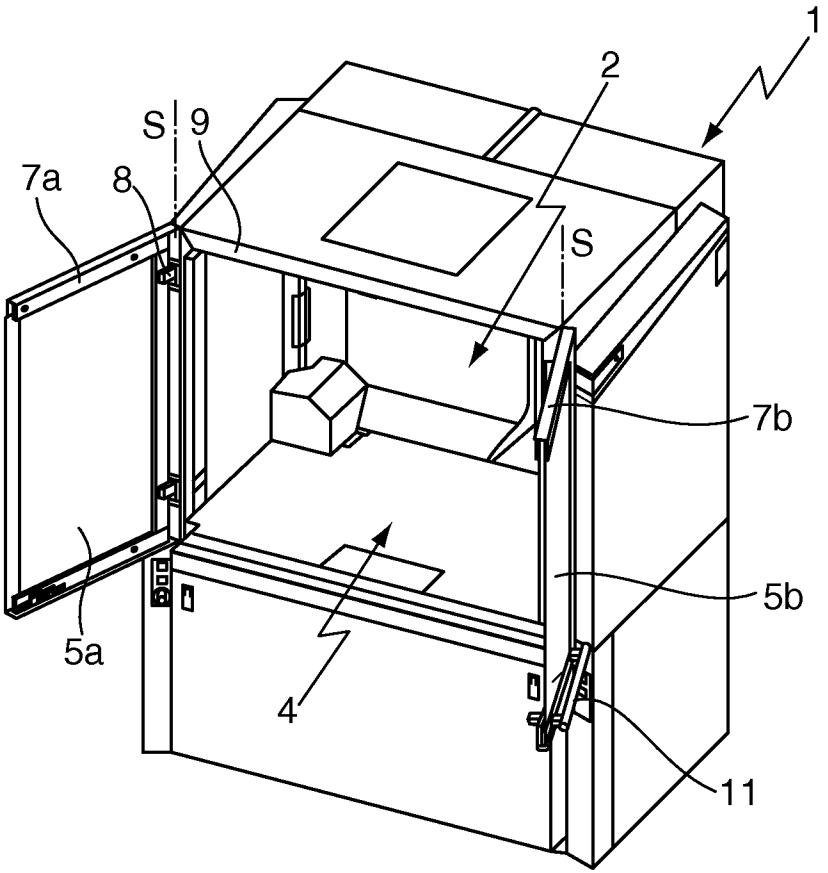
FIG. 1*c* shows the cabinet-like housing of FIG. 1*a* with open casement.

FIGS. 1*a* through 1*c* each show a cabinet-like housing, on which two inventive door configurations 1*a*, 1*b* are formed. In this example, the cabinet-like housing is designed as a safety housing 1 for an X-ray apparatus, e.g. an X-ray diffractometer or an X-ray fluorescence analysis device or a different instrumental-analytical X-ray measuring means (not shown). The safety housing 1 surrounds a working chamber 2 inside the safety housing 1, in which the X-ray apparatus can be disposed. The safety housing 1 has a plurality of stationary protection elements 3*a*-3*c*, which are impermeable to X-ray radiation, e.g. lead-containing side walls 3*a*, ceiling plates 3*b* and floor plates 3*c*.

The working chamber 2 has a front access 4 (FIGS. 1*a*-1*c*), which can be covered by door protection elements 5*a*, 5*b* (in the present case lead glass panes) that are impermeable to X-ray radiation. The door protection elements 5*a*, 5*b* belong to two doors 6*a*, 6*b* of the inventive door configurations 1*a*, 1*b*.

The doors 6*a*, 6*b* have two functions. Each door 6*a*, 6*b* has a (in the present case C-shaped) casement 7*a*, 7*b* which is pivotably disposed on a stationary main frame 9 of the safety housing 1 via hinges 8 (see pivot axes S). Each casement 7*a*, 7*b*, in turn, bears one sliding door 10*a*, 10*b*, which can be moved on the casements 7*a*, 7*b*, respectively (see direction of movement V). Each sliding door 10*a*, 10*b* has a handle 11 that has a manually operable push button 12 of an operating element for actuating the latch. The main frame 9 can be associated with the respective door configurations 1*a*, 1*b* as far as it is used to suspend the doors 6*a*, 6*b*. The main frame 9 typically also completely surrounds the access 4.

FIG. 1*a* shows the safety housing 1 with closed sliding doors 10*a*, 10*b* and closed casements 7*a*, 7*b*, as required during X-ray measurement for shielding the X-ray radiation that is released in the working chamber 2. In order to perform minor manipulations in the working chamber 2, e.g. change the sample, it is sufficient to only open the two sliding doors 10*a*, 10*b*, thereby opening approximately half of the width of the maximum access 4 (FIG. 1*b*). This requires only a relatively little amount of space on the left and right-hand side of the safety housing 1 or the access 4.

For lager-scale manipulation, e.g. exchange of the X-ray apparatus, in the working chamber 2, the casements 7*a*, 7*b* can be pivoted open, wherein the (largely) closed sliding doors 10*a*, 10*b* are also pivoted and the overall maximum access 4 is opened (FIG. 1*c*).

The door mechanism preferably permits movement of the sliding doors 10*a*, 10*b* only when the casements 7*a*, 7*b* are closed and vice versa, the casements 7*a*, 7*b* can only be pivoted when the sliding doors are (largely) closed.

In the illustrated embodiment, each door protection element 5*a*, 5*b* extends over the full width B and the full height H of the area of the access 4 that is covered by the associated door 6*a*, 6*b*.

Figure 2:
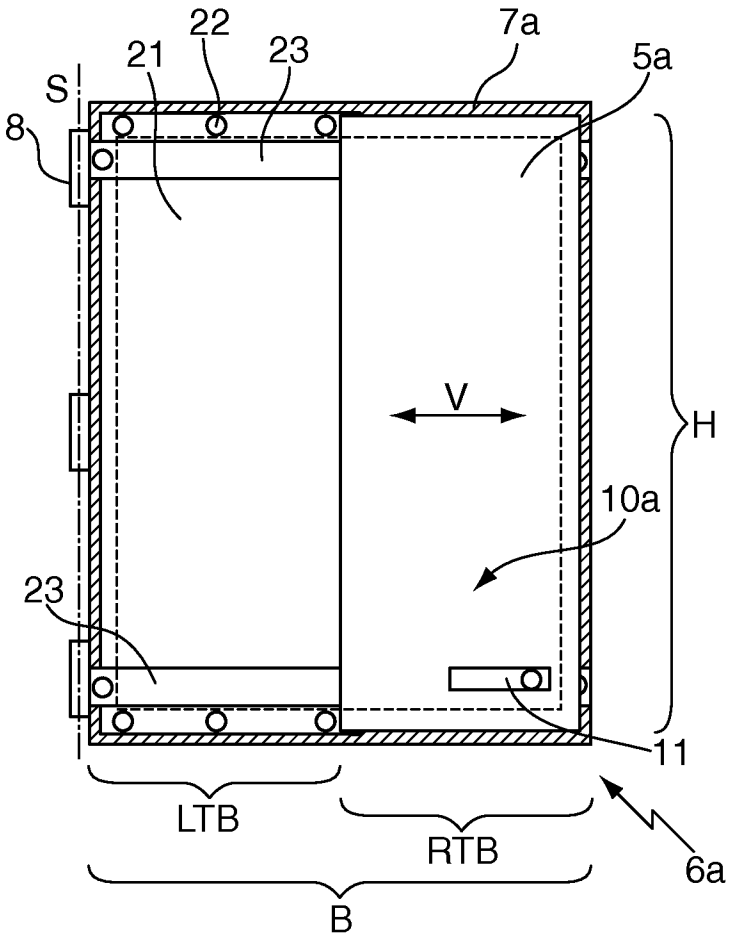
FIG. 2 shows a schematic view of an inventive door configuration with a partial cover that is rigidly mounted to the casement.

FIG. 2 shows a schematic front view of a different design of a door 6*a* of an inventive door configuration 1*a*.

The door 6*a* has a rectangular casement 7*a* (shown in hatched lines, the covered inner border is shown with dashed lines), which is mounted by hinges 8 to the main frame (not shown) of the door configuration 1*a* and can be pivoted about a vertical pivot axis S.

In this case, a door protection element (that can also be called rigid partial cover 21) is rigidly mounted to the casement 7*a* with rivets 22. Two rails 23 are also mounted to the casement 7*a*, which extend over the entire width B of the door 6*a* and are used as a bearing for a sliding door 10*a*. The sliding door 10*a* can be moved on the rails 23 in the direction V. The sliding door 10*a* has a door protection element 5*a* (that can also be called movable partial cover), which can be moved with the sliding door 10*a*. The sliding door 10*a* can be handled via the handle 11.

In FIG. 2, the sliding door 10*a* is closed such that the door 6*a* with the two door protection elements 21, 5*a*, completely covers the access to the working chamber, disposed behind it (e.g. with respect to X-ray radiation, see the safety housing of FIGS. 1*a*-1*c*), in particular, over the entire width B of the door 6*a* or the access. The rigid door protection element 21 thereby covers a left-hand partial area LTB and the door protection element 5*a* of the sliding door 10*a* covers a right-hand partial area RTB of the door 6*a* or the access. Each partial area LTB, RTB corresponds to approximately half the full width B, wherein there is a slight overlap. Both door protection elements 21, 5*a* extend over the full height H of the door 6*a* or the access located behind it.

When the sliding door 10*a* is moved to the left out of the closed position, the access to the working chamber is opened in the right-hand partial area RTB. Towards this end, the sliding door 10*a* does not require any free space on the side of the door (e.g. on the left-hand side of the door) or in front of the door 6*a*, since the sliding door 10*a* can be easily moved in front of the rigid door protection element 21. When full access via both partial areas RTB, LTB is required, the casement 7*a* can be pivoted open.

FIGS. 3*a*-3*d* schematically explain a door mechanism, in particular a latch mechanism, which is used in accordance with the invention in an inventive door configuration 1*a*. Different operating states are thereby schematically shown in cross section.

FIG. 3*a* shows in a first operating mode (sliding door function) a door with a casement 7*a*, which is pivotably mounted by means of hinges (pivot joints) 8 to a main frame 9 (shown in dashed lines). A sliding door 10*a* is disposed (borne) on the casement 7*a*, which can be displaced in the direction V parallel to the casement 7*a*. An operating element 31 in a first (extended) position does thereby not impair the movement of the sliding door 10*a*. The sliding door 10*a* can be moved by a maximum path of displacement SW (in FIG. 3*a* stated for the right-hand end of the sliding door), which corresponds in this case to approximately half the width of the casement 7*a*. The path of displacement SW is limited to ensure the stability of the sliding door bearing and delimit the lateral space requirements (area of risk of collision).

The casement 7*a*, however, is locked. A latch 32, which is disposed on the casement 7*a* such that it can be displaced in a direction R, engages at its right end in a (schematically shown) lug 33 of the main frame 9 such that the casement 7*a* cannot be pivoted open.

FIG. 3*b* shows a first phase of switching over the operating modes. When the sliding door 10*a* is closed (i.e. the sliding door 10 is on the very right) the operating element 31 is inserted. The operating element 31 penetrates through the casement 7*a* in this second position and engages in a recess 32*a* of the latch 32 such that the movement of the latch 32 is coupled to the movement of the sliding door 10*a*.

FIG. 3*c* shows the second phase of switching over the operating modes. When the operating element 31 is inserted, the sliding door 10*a* including operating element 31 is slightly moved to the left by the amount EW (unlocking path) until the latch 32 contacts the mechanical stop 34. The carried-along latch 32 is thereby removed from the lug 33, thereby unlocking the casement 7*a*. It must be noted that the unlocking path EW thereby amounts to approximately ⅕ of the maximum sliding path SW.

Figure 5A:
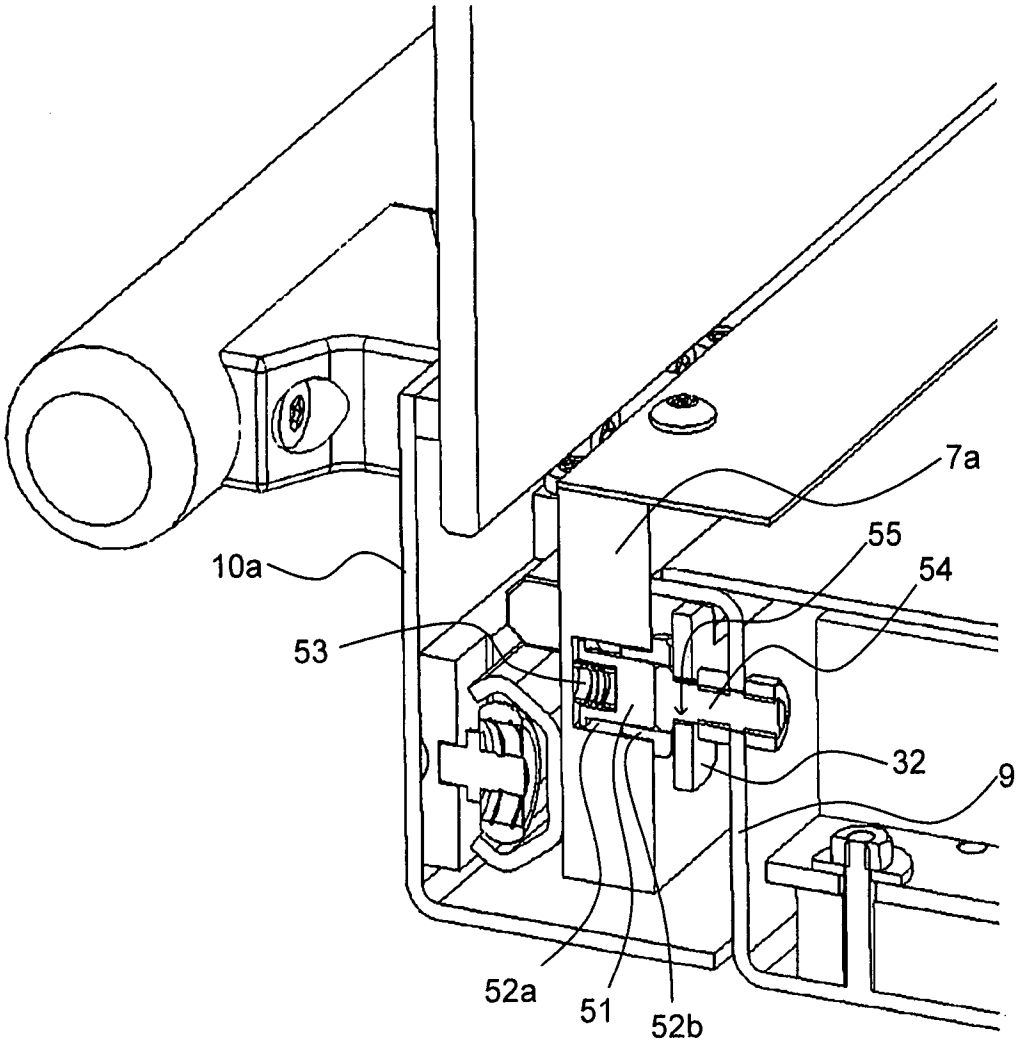
FIG. 5*a* shows a schematic view of a further locking mechanism of a door of an inventive door configuration with an unlocked locking element with closed casement.
Figure 5B:
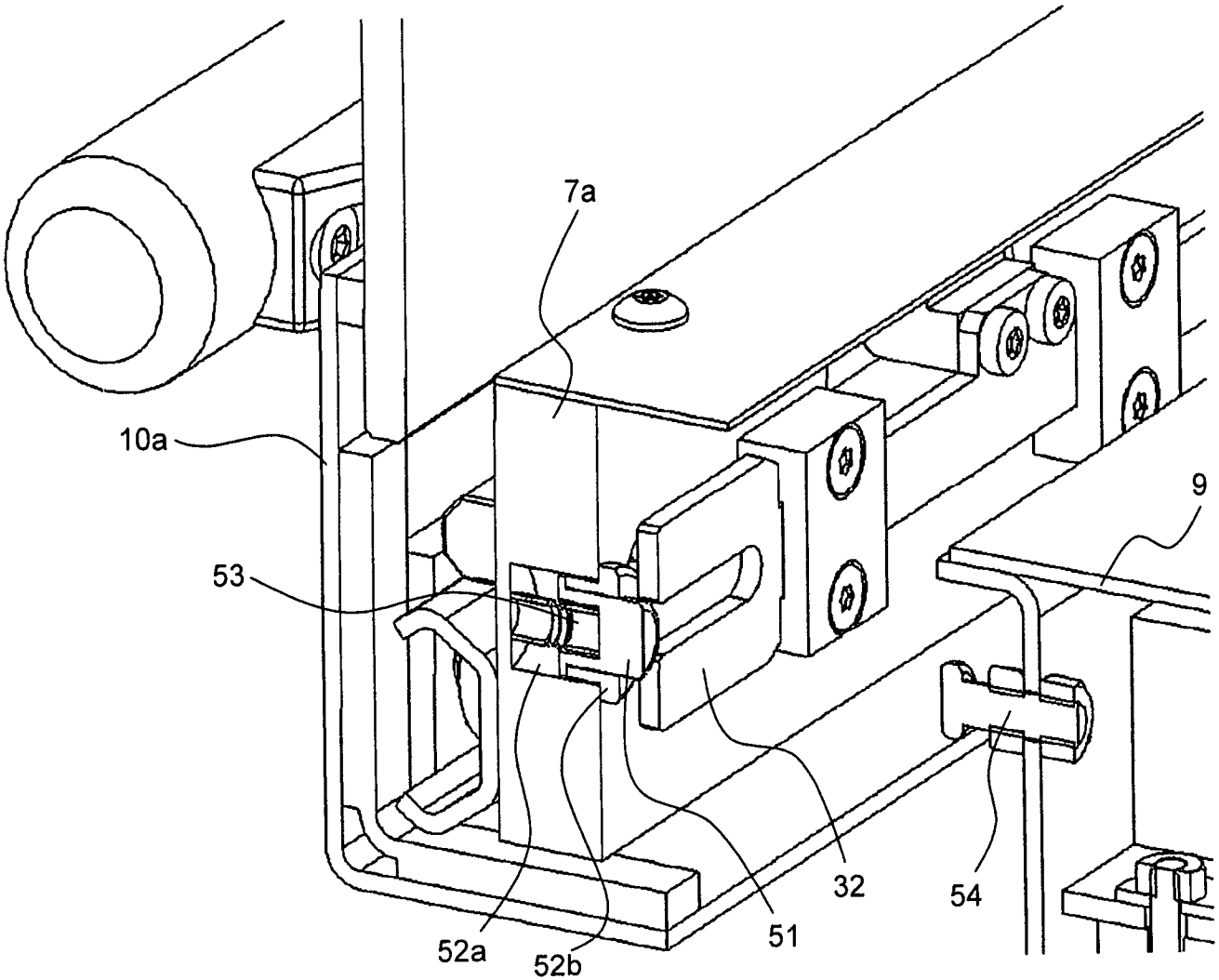
FIG. 5*b* shows the locking mechanism of FIG. 5*a*, in which the casement is opened and the locking element is in the locking position.

FIG. 3*d* shows the second operating mode (folding door function) of the door. The casement 7*a* can be pivoted about the hinge 8. The operating element 31 thereby typically remains in the second position and the sliding door 10*a* is preferably locked in the movement position on the mechanical stop 34 when the casement 7*a* is opened (FIGS. 5*a*, 5*b* show a feasible realization thereof).

FIG. 3*e* shows an alternative inventive door mechanism similar to FIG. 3*a*. In this door mechanism, the latch 32 is not disposed on the casement 7*a* but on the main frame 9 such that it can be displaced in a direction R'. A rigid lug 33*a* is formed on the casement 7*a*, into which the latch 32 can engage in order to lock the casement 7*a* on the main frame 9. FIG. 3*e* shows the locked (and closed) state of the casement 7*a*. The operating element 31 is retracted (in the first position), such that the sliding door 10*a* can be moved in front of the casement in the direction V, wherein the directions V and R' extend parallel to each other.

Figure 4A:
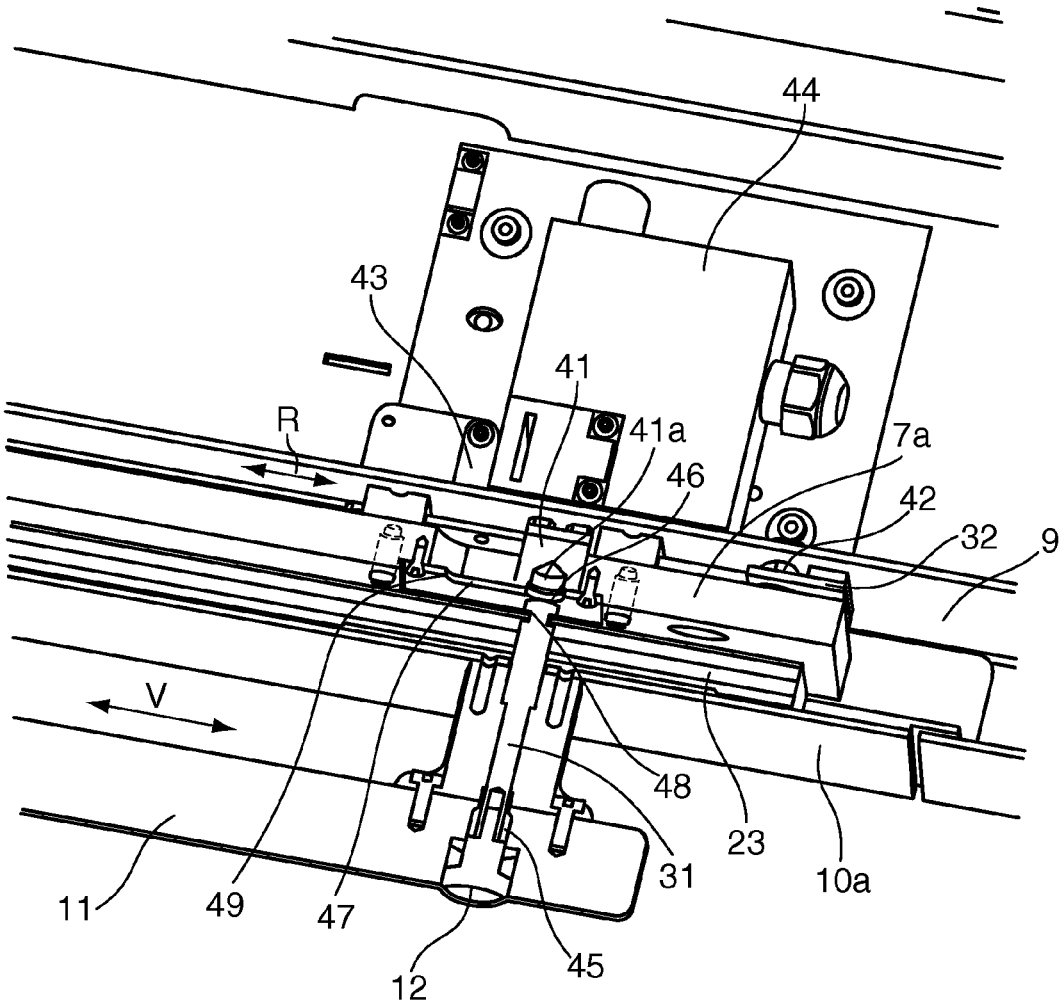
FIG. 4*a* shows a schematic sectional view of a locking mechanism of a door of an inventive door configuration in a first position of the operating element.
Figure 4B:
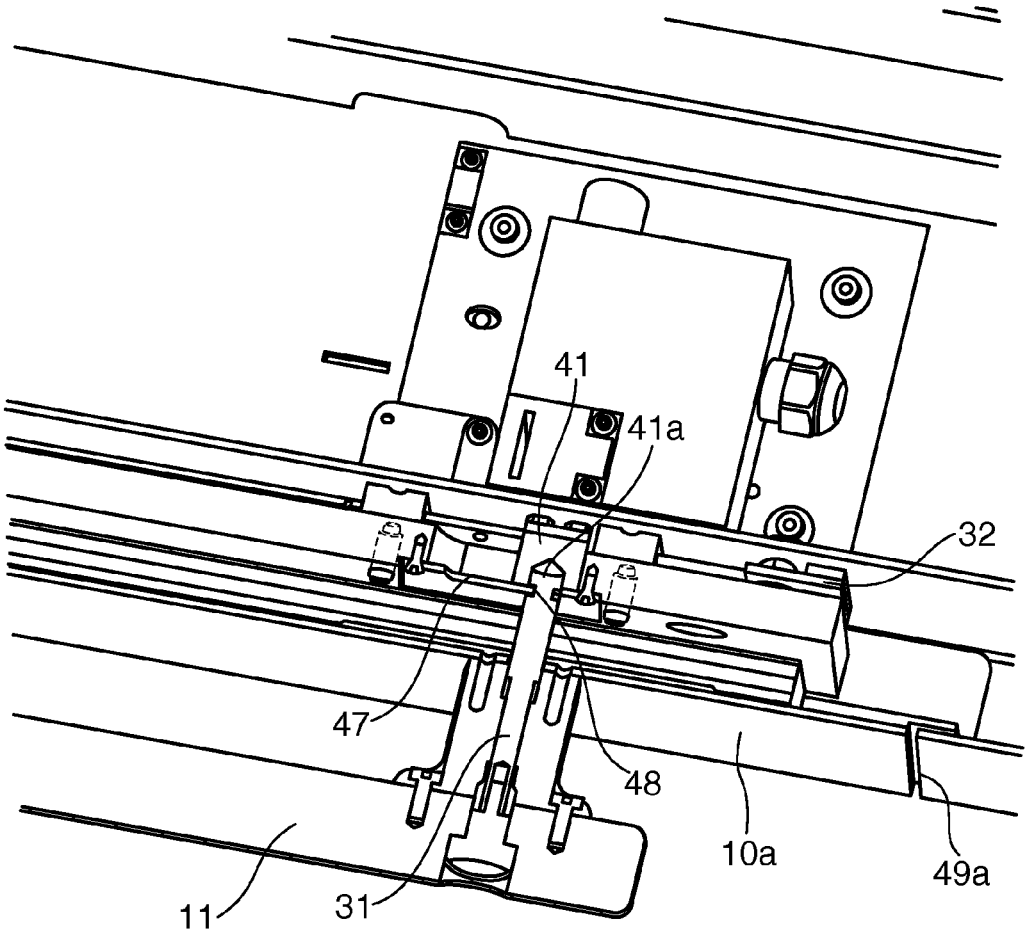
FIG. 4*b* shows the locking mechanism of FIG. 4*a* in a second position of the operating element with locked casement.
Figure 4C:
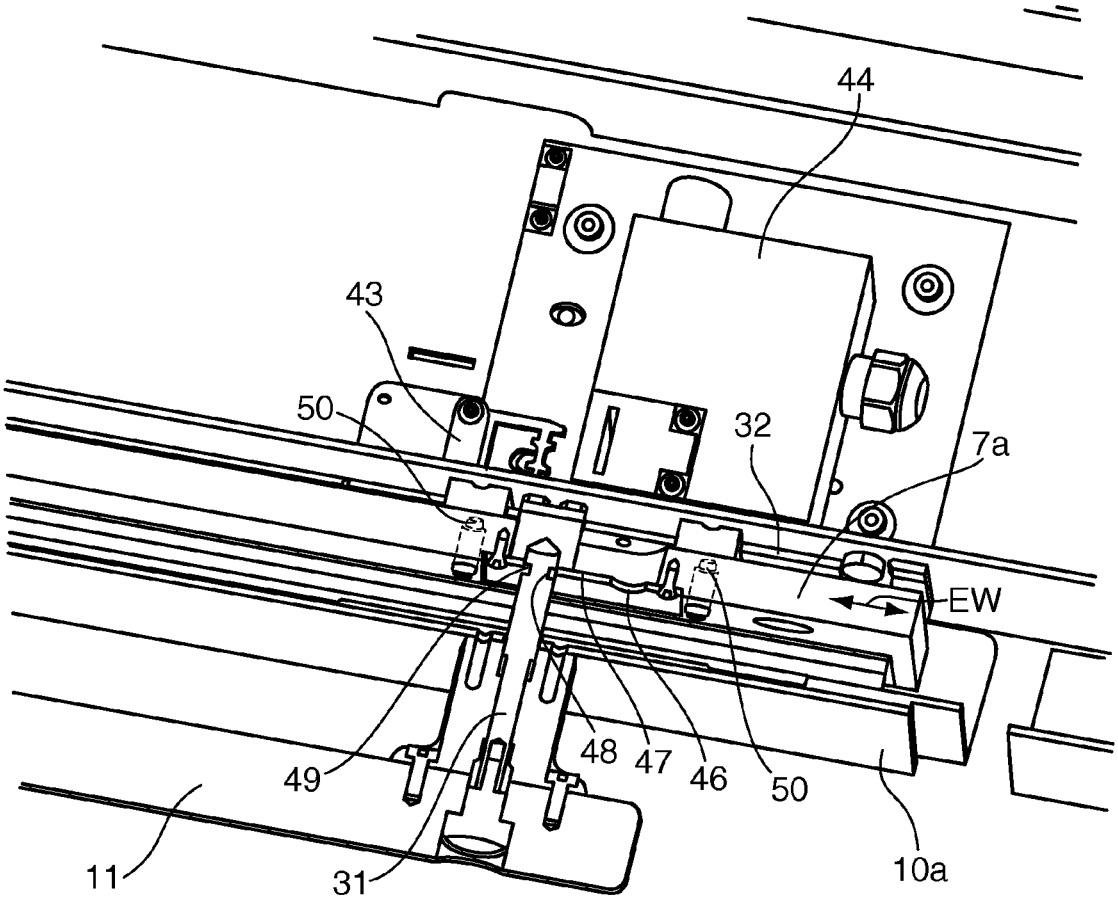
FIG. 4*c* shows the locking mechanism of FIG. 4*a* in a second position of the operating element with unlocked casement.

FIGS. 4*a* through 4*c* show the door locking mechanism of an inventive door configuration in greater detail, which is inserted into a safety housing similar to FIG. 1.

Each section shows one sliding door 10*a*, to which a handle 11 with an inserted substantially pin-shaped operating element 31 (with push button 12) is mounted. The sliding door 10*a* is displaceably disposed on a casement 7*a* by means of a rail (linear guidance) 23. The casement 7*a* abuts a main frame 9 that is stationary during all door operations. A carrier 41 is disposed in the casement 7*a*, which can be displaced in a direction R. The carrier 41 is rigidly connected to a latch 32 that can engage behind a hook (only indicated by reference numeral 42) that is fixed to the main frame 9. The carrier 41 has a recess 41*a* for engagement of the operating element 31. An actuator 43 is moreover rigidly connected to the sliding door 10*a* and can engage in a lock (in the present case a safety module) 44.

FIG. 4*a* initially shows the sliding door function. The operating element 31 is in a first position in which it does not engage in the recess 41*a*. The operating element 31 is thereby pretensioned into this first position by a pressure spring 45. The sliding door 10*a* can then be freely moved on the casement 7*a* in the direction V.

The latch 32 engages behind the hook 42, such that the casement 7*a* is locked on the main frame 9 and, in particular, cannot be pivoted open to the front.

In the position of the sliding door 10*a* shown in FIG. 4*a* (completely closed), the actuator 43 is inserted into the lock (safety module) 44. In this position, an X-ray experiment may be started and continued in the safety housing. The lock 44 blocks opening of the sliding door, and thereby also opening of the casement function, on the actuator (on the safety bracket) 43.

FIG. 4*b* illustrates the first step for switching over the operating mode. When the sliding door 10*a* is closed, the operating element 31 is pushed in against the spring force. In this second position, the front end of the operating element 31 engages into the recess 41*a* of the carrier 41. A widening 46 in the recessed rail 47 is thereby penetrated, which is formed on the casement 7*a* (see FIG. 4*a*). A notch 48 in the operating element 31 is then aligned with the recessed rail 47. Accordingly, the recessed rail 47 only permits switching over of the operating element 31 from the first into the second position via the widening 46 when the sliding door 10*a* is completely closed (see FIG. 4*a*). The completely closed sliding door position is defined by a mechanical auxiliary stop 49*a*.

The engaging operating element 31 couples the motions of the sliding door 10*a* and the carrier 41 and thereby also of the latch 32. When the sliding door 10*a* is moved to the left with the operating element 31 in the second pushed-in position, the latch 32 is carried along by the carrier 41 such that the casement 7*a* is unlatched. The directions R and V are parallel.

FIG. 4*c* shows the door mechanism with the sliding door 10*a* moved to the left and retracted latch 32, i.e. with unlocked casement 7*a*. The notch 48 in the operating element 31 engages the recessed rail 47. The operating element 31 can be displaced along the recessed rail up to abutment with the left-hand side at the end of the recessed rail 47, which accordingly functions as a mechanical stop 49 ("unlocked position of movement"). The mechanical stop 49 delimits the unlocking path EW of the sliding door 10*a* (it must be noted that as an alternative or additionally, the carrier 41 or the latch 32 could also be moved to a corresponding mechanical stop). Since the recessed rail 47 engages in the notch 48, the operating element 31 cannot move back from the second pushed-in position.

In the unlocked position of movement of the sliding door 10*a*, the actuator (the safety bracket) 43 is completely removed from the lock (safety module) 44. For this reason, the actuator 43 no longer obstructs opening of the casement 7*a*. It may be required to initially unlock the lock 44 for moving the sliding door 10*a* into the unlocked position of movement.

The sliding door 10*a* is fixed in the position of movement abutting the mechanical stop 49 by a blocking mechanism. In the illustrated example, the blocking mechanism has two resilient balls 50 that are formed on the casement 7*a* and engage in depressions (not shown in detail) on the latch 32. In order to move the sliding door 10*a* (and thereby also the latch 42) with respect to the casement 7*a* out of the unlocked position of movement, the mechanical resistance of the resilient balls (pressure balls) 50 must be overcome. This secures handling of the handle 11 for opening and closing the casement 7*a*, in particular when the casement 7*a* is open.

After pivoting the casement, e.g. for exchanging an X-ray apparatus in the working chamber of the safety housing, the casement 7*a* is disposed again at the main frame 9 (is closed), and the sliding door 10*a* is moved from its unlocked position of movement on the left-hand side mechanical stop 49 back to the locked (completely closed) position of movement on the right-hand side mechanical auxiliary stop 49*a*. The latch 32 is thereby carried along, which finally locks again the casement 7*a* on the main frame 9. In the completely closed position of the sliding door 10*a*, the operating element 31 moves back into the first position due to the pressure spring 45, and thereby into the sliding door mode.

Securing the unlocked position of movement of the sliding door in the folding door mode may alternatively or additionally not only be impeded but also be mechanically locked by a locking mechanism, which is illustrated in FIGS. 5*a* and 5*b*. These show a perspective approximately front-side view of an inventive door mechanism similar to the door mechanism shown in FIGS. 4*a*-4*c*. FIG. 5*a* shows a closed and locked casement, while FIG. 5*b* shows a pivoted-open unlocked casement.

The casement 7*a* has an approximately cylindrical locking element 51, which is disposed in a depression 52*a* and extends through a bearing bushing (guiding bushing) 52*b*. The bearing bushing 52*b* is glued into the depression 52*a* or fastened in a different mechanical fashion (e.g. screwed). The locking element 51 is pretensioned by a pressure spring (not shown in detail) at an inside 53 of the locking element 51 into a position projecting towards the main frame 9 (see FIG. 5*b*). In this position, the locking element 51 blocks movement of the latch 32. The left-hand side of the latch 32 contacts (in FIG. 5*b*) the locking element 51. This also blocks movement of the sliding door 10*a* (which is hinged to the latch 32 with the operating element and the carrier in FIG. 5*b*) towards the left-hand side (towards the locked position). The latch 32 is then fixed in the unlocked position. The sliding door 10*a* remains held in an unlocked position of movement on a mechanical stop (not shown in FIG. 5*b*).

When the casement is closed (i.e. applied to the main frame 9, see FIG. 5*a*), the locking element 51 is pressed into the depression 52*a* by a counter means (guiding bolt) 54 that is rigidly formed on the main frame 9. The locking element 51 is then no longer in the path of movement of the latch 32. There is only a narrowing 55 of the counter means 54 in the area of the path of movement of the latch 32, which can, however, be surrounded by the latch 32 that is approximately C-shaped in its end area, such that the counter means 54 does not block the path of movement of the latch 32. When the casement 7*a* is closed, the latch 32 can be actuated by the sliding door 10*a* and, in particular, be locked (i.e. be moved to the left in FIG. 5*a*). In FIG. 5*a*, the latch is in the locked position, wherein the left-hand bracket-like part of the latch 32 is not shown for reasons of simplicity. The thickened, free end of the counter means 54 thereby acts as engagement hook for the latch 32 in order to fix the casement 7*a* to the main frame 9.

In summary, the present invention describes a door configuration for locking an access with a door, wherein the door configuration has a double frame system which permits both a pivoting function and a sliding function of the door. This double function saves space in front of the access when only the sliding door function is used. Both functions can be operated via one single operating element via the sliding door, wherein slight movement of the sliding door in a second position of the operating element is used to operate a latch (or a latch system with several individual latches). This achieves high operational comfort and simple construction. In particular, no external tools or auxiliary means are required for switching over between the functions. When the sliding door function is activated, the folding door function is mechanically locked, and when the folding door function is activated, the sliding door is mechanically locked. The access can be secured by one single lock.

I claim:

1. A door configuration comprising:

a main frame;

a door member structured, disposed and dimensioned to open and close an access opening defined by said main frame, said door member having a casement cooperating with said main frame and structured to pivot with respect to said main frame about a pivot axis as well as a sliding door disposed on said casement for displacement in a sliding direction;

a latch for locking and unlocking said casement in a closed state thereof relative to said main frame; and an operating element disposed on said sliding door for motion together with said sliding door, said operating element having a first position in which said operating element does not obstruct movement of said sliding door on said casement and in which movement of said sliding door does not influence a position of said latch, said operating element also having a second position in which said operating element engages with said latch or with a carrier that is rigidly connected or hinged to said latch, such that, when said casement is closed and said operating element is in said second position, said latch is operated when said sliding door is displaced in said sliding direction, wherein said operating element comprises a pin, said pin being manually pushed inwardly, perpendicular to said pivot axis and perpendicular to said sliding direction, from said first position of said operating element into said second position of said operating element.

2. The door configuration of claim 1, wherein said sliding door covers said access opening when said casement and said sliding door are closed.

3. The door configuration of claim 1, wherein said sliding door extends in a direction perpendicular to said sliding direction over an entire height of said access opening.

4. The door configuration of claim 1, wherein said door member comprises a partial cover for access said opening which is rigidly mounted to said casement, wherein, when said casement and said sliding door are closed, said sliding door extends over a first partial area of said access opening in a direction parallel to said sliding direction and said partial cover extends over a second partial area of said access opening in a direction parallel to said sliding direction, wherein said first plus said second partial areas cover an entire width of said access opening.

5. The door configuration of claim 4, wherein said first and said second partial areas overlap.

6. The door configuration of claim 4, wherein, when said casement is closed and said sliding door is closed, said first partial area extends approximately over half a width of said access opening parallel to said sliding direction.

7. The door configuration of claim 1, wherein, when said sliding door is closed and said casement is closed, said sliding door covers said access opening in a border region thereof that is remote from said pivot axis and said sliding door is slid open from a closed position thereof towards said pivot axis.

8. The door configuration of claim 1, wherein, in said second position of said operating element, said latch locks said casement when said sliding door is closed and releases said casement when said sliding door is opened.

9. The door configuration of claim 1, wherein, in said second position of said operating element, displacement of said sliding door away from a closed position thereof is delimited by a mechanical stop, said mechanical stop thereby restricting displacement of said sliding door along an unlocking path EW which is shorter than a sliding path SW of said sliding door on said casement in said first position of said operating element.

10. The door configuration of claim 9, wherein $EW \leqq 0.2*SW$ or $EW \leqq 5$ cm.

11. The door configuration of claim 9, wherein said door member has a locking mechanism which blocks displacement of said sliding door away from said mechanical stop when said casement is not closed and when said operating element is located in said second position.

12. The door configuration of claim 11, wherein a movable locking element is provided on said casement which is pretensioned by a force of a spring into a locking position blocking a path of movement of said operating element, said latch or said carrier in said second position, said locking element being pushed out of said path of movement of said operating element, said latch or said carrier in said second position when said casement is closed, through interaction with a counter means that is rigidly formed on said main frame.

13. The door configuration of claim 9, further comprising a mechanism for blocking displacement of said sliding door away from said mechanical stop.

14. The door configuration of claim 13, wherein said blocking mechanism comprises a resilient ball in said casement which engages in a depression in said latch.

15. The door configuration of claim 1, wherein said casement has a guidance which holds said operating element in said second position when said sliding door is moved out of a closed position thereof in said second position of said operating element and which only permits changing over between said first and said second position when said sliding door is closed.

16. The door configuration of claim 15, wherein said guidance has a recessed rail along which said operating element is guided in a notch of said operating element, said recessed rail having a widening through which said operating element is displaced between said first and said second position when said sliding door is closed.

17. The door configuration of claim 1, wherein said pin is retracted and extended and is pretensioned by a force of a spring into a retracted position that corresponds to said first position of said operating element and is manually pushed into an extended position which corresponds to said second position of said operating element.

18. The door configuration of claim 1, wherein said latch is disposed on said casement such that it is displaced parallel to said sliding direction.

19. The door configuration of claim 1, wherein said latch is disposed on said main frame such that it is displaced in a direction parallel to said sliding direction when said casement is closed.

20. The door configuration of claim 1, further comprising a lock disposed on said main frame to block and release a position of movement of said sliding door when said casement and said sliding door are closed.

21. The door configuration of claim 1, wherein said sliding direction extends perpendicularly to said pivot axis.

22. The door configuration of claim 1, wherein said casement. is C-shaped, wherein an open side of said C-shaped casement faces away from said pivot axis.

23. A double door configuration comprising two adjacent door configurations according to claim 1, wherein the two doors of the door configurations constitute two opposite wings of a double door.

* * * * *